US005644189A

United States Patent [19]

Busby

[11] Patent Number: 5,644,189

[45] Date of Patent: Jul. 1, 1997

[54] STRAIN AND VIBRATION RESISTANT HALOGEN LIGHT BULB FOR AIRCRAFT AND METHOD

[75] Inventor: Jeffrey D. Busby, Ft. Worth, Tex.

[73] Assignee: Bunker Sales & Marketing, Inc., Carrollton, Tex.

[21] Appl. No.: 385,952

[22] Filed: Feb. 8, 1995

[51] Int. Cl.[6] ..... H01J 5/48

[52] U.S. Cl. ..... 313/318.01; 362/62

[58] Field of Search ..... 313/318.01, 318.05, 313/312; 362/62

[56] References Cited

U.S. PATENT DOCUMENTS

| | | | |
|---|---|---|---|
| 467,982 | 2/1892 | Piffard | 439/605 |
| 1,619,100 | 3/1927 | Brush | 362/62 |
| 2,852,040 | 2/1958 | Dorsey | 439/427 |
| 3,322,992 | 5/1967 | Parker et al. | 313/111 |
| 3,848,120 | 11/1974 | Wolfe et al. | 362/296 |
| 3,946,263 | 3/1976 | Protzeller | 313/312 |
| 3,997,809 | 12/1976 | Kype | 313/160 |
| 4,126,810 | 11/1978 | Cox | 313/318.08 |
| 4,223,190 | 9/1980 | Olson | 200/84 R |
| 4,296,397 | 10/1981 | Sedberry | 337/199 |
| 4,345,178 | 8/1982 | Pappas et al. | 313/113 |
| 4,434,650 | 3/1984 | Perry et al. | 73/61.51 |
| 5,010,298 | 4/1991 | Urmura | 324/207.19 |
| 5,137,478 | 8/1992 | Graf | 439/874 |
| 5,295,120 | 3/1994 | McShane | 367/188 |

OTHER PUBLICATIONS

Raychem—Thermofit® Viton,* Viton-HW—Product Sheets, Nov. 1988 (8 pages).

Raychem—Thermofit® Adhesive S-1125—Product Sheets, 14 Mar. 1988 (5 pages).

Raychem—Thermofit® Adhesive S-1255-02—Product Sheets, 17 Jul. 1991 (10 pages).

Raychem—S-1255 Adhesive Installation Guide—25 Jan. 1994 (4 pages).

Raychem—Thermofit® RT-555 Tubing—Product Sheets, 14 Jun. 1993 (7 pages).

Raychem—Material Safety Data Sheet, Issue No. 6, Serial No.: RAY/3112, Product Name: Thermofit Heat-Shrinkable Polymeric Products (4 pages).

Raychem—Material Safety Data Sheet, Issue No. 3, Serial No. RAY/3131, Product Name: Raychem S-1255-02, Nov. 1994 (4 pages).

*Primary Examiner*—Alvin E. Oberley
*Assistant Examiner*—Lawrence O. Richardson
*Attorney, Agent, or Firm*—John W. Montgomery

[57] ABSTRACT

A rigidified quartz-halogen light bulb and method for forming an improved vibration-resistant, high temperature light bulb is provided in which the terminals of the high temperature light bulb and lead wires attached to the terminals at attachment sites are coated with thermal-setting epoxy. The thermal-setting epoxy is covered with individual heat-shrinkable sleeves. High temperature, thermal-setting epoxy is fillingly adhered between the individual shrink-fit sleeves and is partially adhered to the base of the light bulb. An exterior shrink-fit tubing is applied, encasing all of the terminals, lead wires, attachment sites, epoxy coatings, individual sleeves and interposed fill epoxy. The entire composite is cured in position to provide the rigidifying structure in combination with the light bulb.

14 Claims, 4 Drawing Sheets

STRAIN AND VIBRATION RESISTANT HALOGEN LIGHT BULB FOR AIRCRAFT AND METHOD

TECHNICAL FIELD OF THE INVENTION

This invention relates to high output lighting applications typically addressed with quartz-halogen non-reflectorized light bulbs mounted in separate reflector assemblies connected to electrical power, such as aircraft generator power, through attached insulated wire leads, and particularly to a light bulb which has a terminal construction which is resistant to vibration and strain damage; and which construction provides additional insulating characteristics. The invention also relates to a method for retrofitting existing quartz-halogen bulbs for extended usage under high temperature and high vibration conditions usage without lead failure.

BACKGROUND OF THE INVENTION

Light bulbs have been constructed for many years with an evacuated glass enclosure or with a gas-filled glass enclosure having a filament positioned inside and sealed within the glass enclosure or bulb. Electrical terminals have been connected to the filament and sealingly secured through a base, which may include a compound of rubber, resin or plaster of paris molded around the electrical terminals. The base provided mechanical support for the filament within the bulb and for the terminals or connecting pins extending from the base. One early example of a light bulb with a support base is shown in U.S. Pat. No. 467,982. Also, from an early time, light bulbs have been attached to aircraft wings, as disclosed in U.S. Pat. No. 1,619,100, which discloses a rudimentary method for securing a bulb to an aircraft wing. In particular, a rubber strap is shown to have been used for the purpose of securing a light bulb to an airplane wing.

Incandescent light bulbs now must operate reliably for long periods of time in a particularly high vibration environment of high-speed, jet-propelled aircraft. Aircraft manufacturers have partially addressed some of the difficulties associated with high vibration by using fluorescent bulbs whenever possible, as for example, in passenger seating and cockpit areas. However, fluorescent bulbs are not acceptable for all aircraft purpose because of their physical size limitations which require sufficient mounting area, and also because the light output from fluorescent bulbs is not always adequate.

High output lighting applications are addressed with the use of incandescent bulbs, and typically quartz-halogen bulbs, either with an integral reflector, as for example, with landing lights, or bare, non-reflectorized bulbs which are mounted in separate mounting assemblies, as for example, marker, navigation and position lights. The non-reflectorized bulbs are typically connected to aircraft power through insulated wire leads, which are attached, as by spot welding, to short terminal pins which connect to the bulb filament. Aircraft users have reported high failure rates with non-reflectorized bulbs due to wire lead breakage and/or shorting at the base of the bulb. In the past, the high operating temperature of the quartz-halogen bulbs, reportedly greater than about 200° C. and as high as about 300° C. or higher when in an enclosed area, as well as potential for exposure to chemicals such as hydraulic fluids, lubricating oils, jet engine fuel and anti-icing, de-icing and defrosting fluids has hindered prior attempts to insulate the wires from shorting. Further, insulation alone does little to reduce the high failure rate due to inadvertent excess strain on the pins and wire connectors or fatigue failure to excessive vibration.

In other situations where bulb assemblies have needed to operate in underwater or submerged conditions and associated environments where the lamp may be subjected to extreme temperatures and various corrosive conditions, total encapsulation of the bulb has been disclosed, as in U.S. Pat. No. 3,946,263. According to this disclosure, a silicon rubber coating is sprayed around the entire bulb, including on the electrical terminals for providing waterproofing. After the silicon rubber is applied, then a boot is filled with additional silicon rubber and is secured over both of the bulb terminals simultaneously. The silicon rubber composition is allowed to cure such that the bulb is substantially watertight. However, while the silicon rubber provides electrical insulative characteristics and also provides some resistance to certain types of corrosive environments, such as water, the silicon rubber continues to remain flexible and does not provide the type of rigid mechanical separation between the wire terminals which will adequately prevent inadvertent strain. Further, the flexible silicon rubber continues to allow the wire to vibrate within the rubberized silicon at the high frequencies sometimes present with jet turbine aircraft engines.

There continues to be a need for vibration-resistant, high temperature halogen light bulbs, and also, for a method of constructing such bulbs. There is a particular need for a method of retrofitting existing light bulbs which are currently used in specific types of mounting devices found in use as wingtip position indicator lights in a large number of existing aircraft. Particularly, it has been found that the failure rate, for light bulbs currently used as wing position indicator lights in large fleets of MD80's, is very high, resulting in a maintenance schedule which must be accelerated due to a terminal or connection failure rate, which failure rate is higher than the normal maintenance schedule which is designed to address the filament expected failure rate.

SUMMARY OF THE INVENTION

Applicant's invention specifically addresses and reduces the normally high failure rate of incandescent light bulbs in aircraft applications, which high failure rate has been found to result from inadvertent strain, terminal shorting and vibration failures. Particularly, the invention is applicable for the continuous high temperature operating environment of non-reflective quartz-halogen light bulbs of the type used in aircraft wingtips as position-indicating lights. One aspect of the invention is to provide additional mechanical support at each of the connection sites between the bulb terminals and the attached lead wires. This mechanical support is uniquely provided with a combination structure, including a high-temperature, thermal-setting epoxy covering which is adhered and cured at each connection site between terminals and lead wires. A particular type of thermal-setting epoxy is applied, extending from the bulb base along the terminal to beyond the lead wire attachment site, and preferably overlaps onto the insulation of the electrical wire. Prior to complete curing, a shrink-fit electrical insulating tubing is applied over the epoxy coated area to provide additional rigidity, mechanical strength and electrical insulation capabilities. The wires and terminals are thus rigidified against vibration damage, and also are prevented from inadvertently shorting to each other or to the mounting bracket. Particularly, both the thermal-setting epoxy and the shrink-fit insulating tubing which have been discovered to be advantageously useful have exceptionally high temperature operating strength characteristics, as well as chemical resistance against jet fuels, cleaners, lubricants, hydraulic fluids and de-icing chemicals.

Another aspect of the invention is the application of additional mechanical support in the form of additional thermal-setting epoxy interposed and filled between the epoxy-coated and shrink-fit insulated terminals and lead wire connection sites. This interposed thermal-setting epoxy is further secured in position with another electrically insulating shrink-fit sleeve, which encompasses all of the epoxy-coated, individually sleeved terminals of the light bulbs—typically two terminals for each bulb—as well as the lead wires and the interposed thermal-setting epoxy. Upon application of the additional interposed epoxy and the encompassing shrink-fit insulating sleeve, the assembly, including the individual layers of epoxy, the individual shrink-fit sleeves, the interposed epoxy connections and the shrink-fit exterior tubing which encompasses the entire material, is all heated for a predetermined time at a predetermined temperature to allow the epoxy to fully cure. In this process, the epoxy is purposefully allowed to adhere to the insulative base of the light bulb. The encompassing shrink-fit exterior sleeve is allowed to squeeze the lead wires toward to each other at a position spaced away from the base of the bulb, where the lead wires are insulated from each other by both their standard insulation, as well as the epoxy and the individual sleeves. A tapered, approximately conical support structure results and is cured on the terminal connection sites at the base of the light bulb. This tapered or conical support structure further advantageously allows the light bulb to be inserted into a typical bulb mount structure without inadvertent bumping, rubbing or otherwise straining the electrical wire connections as might otherwise occur during a normal process of bulb replacement.

Another aspect of the invention is that an extremely high temperature epoxy is used, as in combination with high temperature, shrink-fit sleeve tubing—both for the individual sleeves and for the exterior covering sleeve—so that the resulting support structure maintains adequate strength characteristics even at continuous high operating temperatures of greater than about 200° C. and as high as about 300° C., or higher when in an enclosed area, for many hours during taxiing, takeoff, flight, landing and terminal parking between flights.

A further aspect of the invention is the method of application of the thermal-setting epoxy in the form of an epoxy-adhesive tape material, which is cut to predetermined lengths for circumferentially wrapping around the terminal-to-lead-wire attachment site. The epoxy-adhesive tape material is wrapped and heated so that it securely adheres to the terminal and wire surfaces, as well as to the insulative base of the light bulb and the standard lead wire insulation. In particular, a fluid-resistant, high temperature one-part epoxy tape, marketed by and commercially available from Raychem Corporation under the name Thermofit® adhesive S-1255-02, has been found to have advantageous operating characteristics for the purposes of the present invention when applied according to the present inventive method. Further, heat-shrinkable sleeves of a modified fluoropolymer, radiation cross-linked, flexible, abrasion-resistant and flame-retardant tubing, marketed by and commercially available from Raychem Corporation under the name Thermofit® RT-555 tubing, is advantageously useful according to the invention in combination with the Raychem Corporation Thermofit® adhesive flexible epoxy. The combination provides durable, continuous high temperature operating capabilities according to the present invention.

BRIEF DESCRIPTION OF THE DRAWINGS

These and other objects and advantages will be more fully understood with reference to the following detailed description of the preferred embodiments, claims and drawing figures in which like elements represent like elements and in which:

DETAILED DESCRIPTION OF THE PREFERRED EMBODIMENTS

Figure 1:
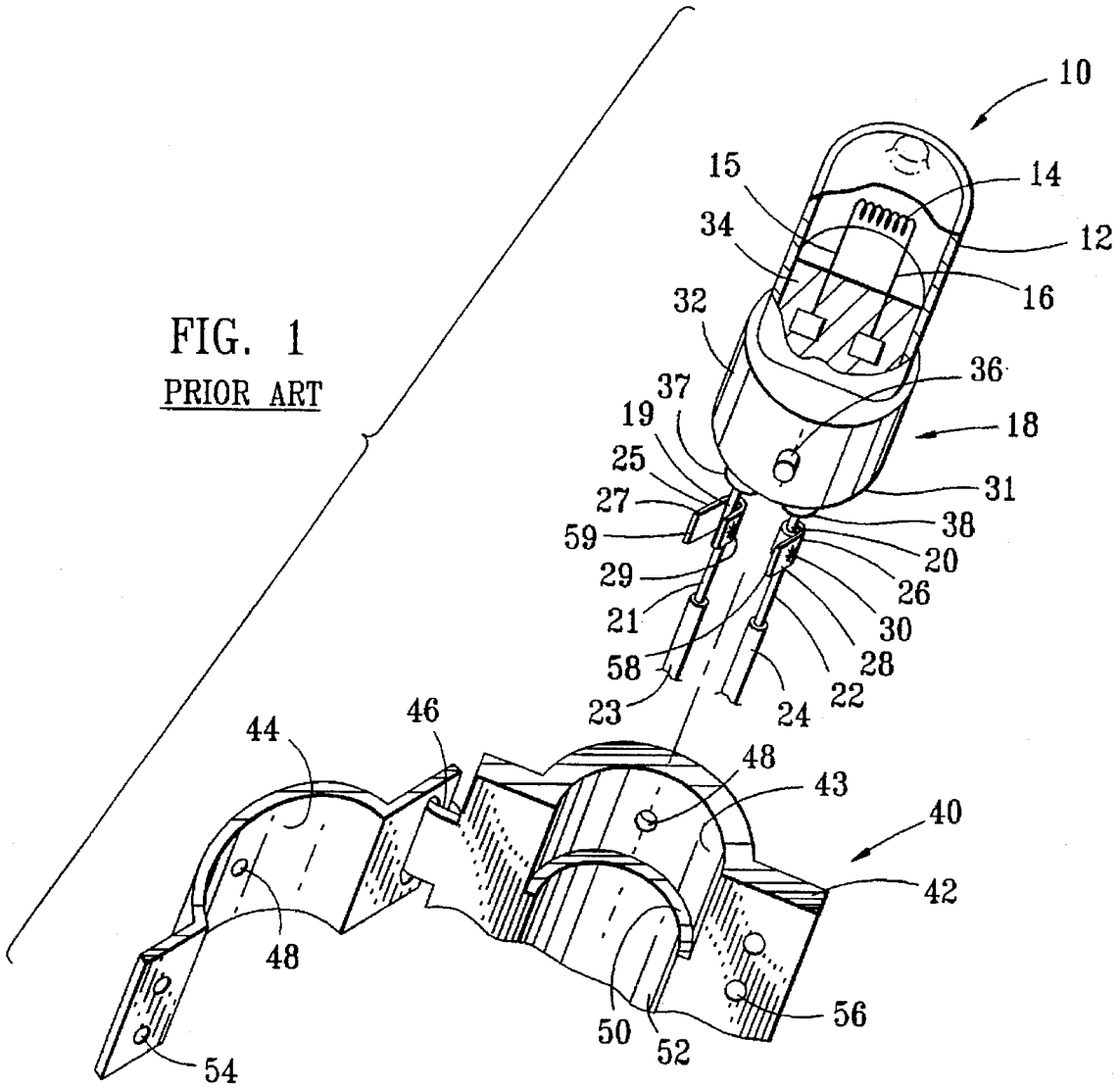
FIG. 1 PRIOR ART
FIG. 1 is a schematic perspective assembly view of a prior art quartz-halogen light bulb and a portion of an aircraft wingtip mounting bracket.

FIG. 1 is a schematic assembly view of a prior art quartz-halogen light bulb and aircraft mount assembly. The quartz-halogen bulb 10 includes a sealed glass tube or bulb 12. The filament 14 is sealingly connected within the interior of the bulb for receiving electrical current through conductors 15 and 16, which sealingly extend through base 18, interconnecting with terminals or pins 19 and 20. Lead wires 21 and 22, each of which is insulated with wire insulators 23 and 24, respectively, are attached to terminals or connector pins 19 and 20 at attachment sites 25 and 26, respectively. In a typical quart-halogen bulb assembly 10, the attachment between the lead wires and terminals is made, for example, using "U" shaped clips 27 and 28, which may be crimped over the lead wires and the terminals, thereby connectably holding them together. The junctions may also be spot welded, as at spot welds 30, or soldered, as with high temperature, as with high temperature solder, or otherwise connected. The base 18 of the bulb assembly 10 includes a metal base rim 32, which is secured to the glass bulb 12, as with a solidified filler material 34. The base 18 provides an appropriate mounting mechanism which may include, for example, a locator pin 36 projecting from the metal rim 32. Typically, the sealed glass tube 12 will have lower base glass projection 31, which may include projections 37 and 38, through which the conductors 15 and 16 and/or terminals 19 and 20 extend below the base 18 of the bulb assembly 10. An aircraft bulb mount 40 is further depicted in which the main mounting fixture 42 has a concave, semicircular or semi-cylindrical portion 43 sized for engagement with the metallic rim 32. A clamp bracket 44 is also provided, having a corresponding semicircular or semi-cylindrical shape, which acts together with fixture 42 to form a cylindrical mounting socket for securely engaging the mounting base 18 of the bulb 10. Clamp bracket 44 may, for example, be pivotably attached to mounting fixture 42 at a hinge 46. Locating pin orifices 48 may be formed in the main mounting fixture 42, as well as in the clamp bracket 44 for alignment and engagement with locator pin or pins 36. Further, the aircraft bulb mount 40 includes a bottom ledge 50, formed by a semi-circular projection 52, which extends inward from a lower portion of the concave, semicircular or semi-cylindrical mount surface 43, to prevent the bulb from vibrating inward. The ledge 50 and inward projection 52 facilitates alignment for mounting and for ease of replacement, but it limits the opening area by which the lead wires and connector pins may be inserted through the bulb mount 40. Lock wire holes 54 in the clamp bracket 44 and mating lock wire holes 56 in the mount fixture are provided according to appropriate industry standards for aircraft assemblies.

Further understanding will be had with reference to FIGS. 2, 3, 4 and 5, which are schematic side perspective views of a bulb 10, at various steps of a process of construction according to the invention. Terminal pins 19 and 20 are attached to connecting wires 21 and 22 at attachment sites 25 and 26, respectively. The attachment depicted includes "U" shaped clips 27 and 28, by which the wires and terminals have been spot-welded together, as with the prior art quartz-halogen light bulb assemblies set forth in FIG. 1, above. According to the present invention, the improved light bulb is preferably constructed with a smoothed attachment site, which, for example, may be accomplished by removing any excess tab portions 57 and 58 of the "U" shaped clips 27 and 28. Alternatively, the junctions or attachment sites may be smooth-soldered or sleeved with a metal conductor material (not shown). This initially reduces the risk of shorting contact between the terminals 19 and 20, because of projecting tabs 57 and 58 at the attachment sites 25 and 26. Separate epoxy coatings 82 and 84 (see FIG. 3) are applied to attachment sites 25 and 26, respectively. An epoxy coating 82 is applied around the smoothed attachment site 25 of terminal 19 to lead wire 21, and epoxy 84 is applied around smoothed attachment site 26 of terminal 20 to lead wire 22.

Figure 2:
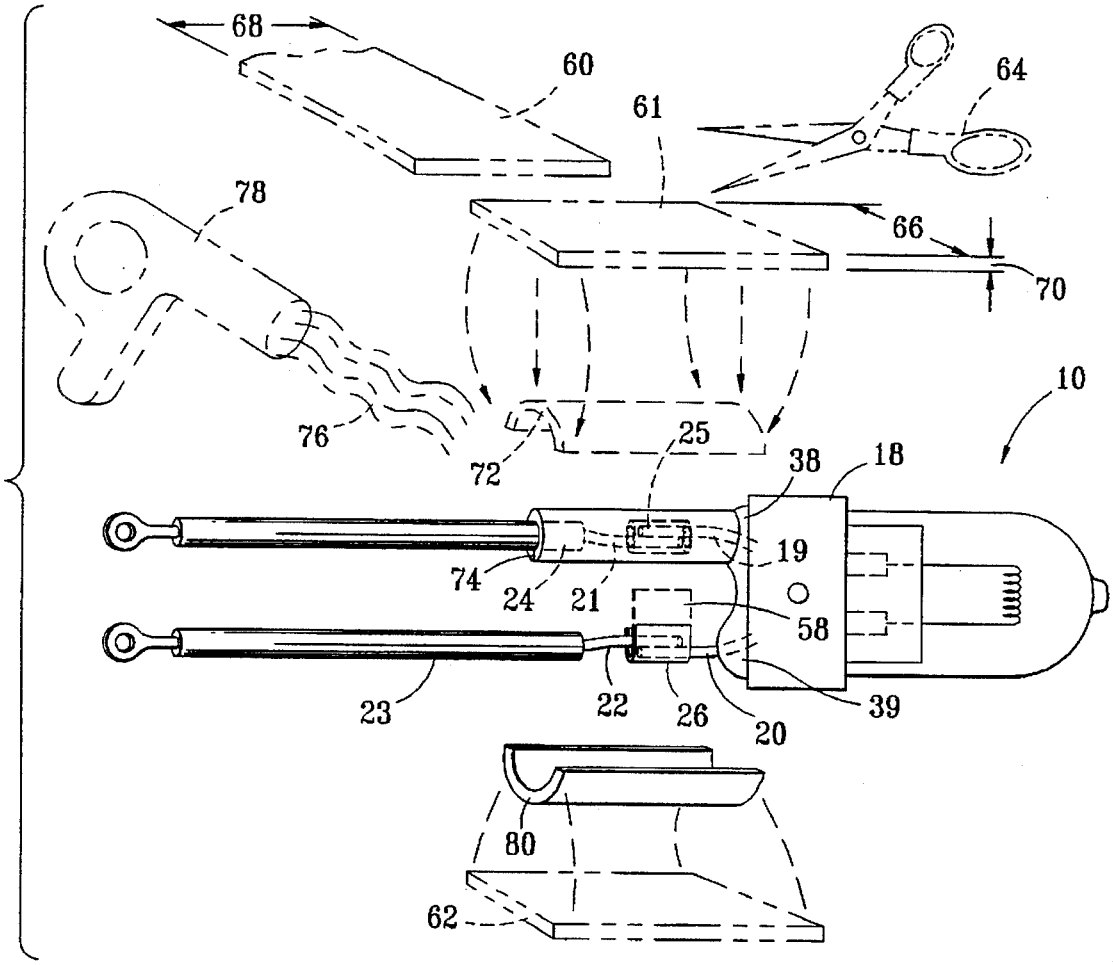
FIG. 2 is a schematic side view depicting a quartz-halogen light bulb and lead wire assembly, which is shown in the process of being constructed and/or retrofit according to one alternative embodiment of the invention, and materials and tools useful in the method of construction are schematically depicted in phantom lines for illustrative purposes.
Figure 4:
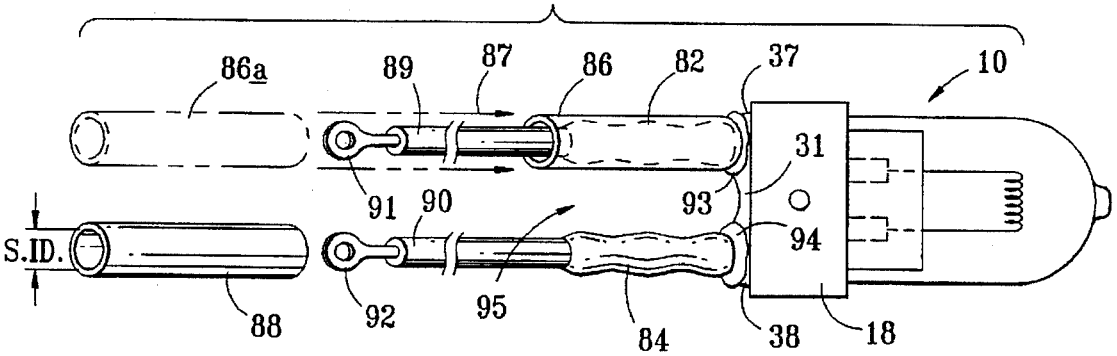
FIG. 4 is a schematic perspective assembly view of a light bulb being further constructed and continuing from the process according to FIGS. 2 or 3, and particularly depicting the addition of individual protective heat-shrinkable sleeves.

Preferably, as shown in FIG. 2 in one alternative embodiment, the epoxy coatings 82 and 84 (as shown in FIG. 4) are formed of an epoxy tape 60, may be provided or cut into pieces of tape 61 and 62. The width 68, of tape 60 and of the cut pieces 61 and 62, is sufficient to extend from the base projections 37 and 38 to beyond the attachment sites 25 and 26. The length 66 of pieces 61 and 62 is sufficient to wrap at least one time circumferentially around each of the terminals, wires and attachment sites 25 and 26, including completely covering connectors 27 and 28. Preferably, the epoxy wraps circumferentially around each terminal and lead wire and extends from the base 18 to the insulation 23 and 24 of each lead wire 21 and 22, respectively.

In the first alternative process, as depicted in FIG. 2, tape piece 61 is bent (as shown at 72) and subsequently is wrapped entirely wraps around the attachment site 25 (as shown at 74). The wrapped epoxy tape is heated with heat 76 from a heat source, such as a heating gun 78 (depicted at phantom lines) until the epoxy tape partially melts and securely adheres to the terminal 19 and wire 21, and also preferably adheres to a portion of base projections 37 and 38 at one end, and to wire insulation 24 at the other end. Similarly, tape piece 62 is bent (as shown schematically at 80) and is subsequently wrapped around the attachment site 26, extending from the base projection 38 overlying the terminal 20, wire 22 and insulator 23.

Figure 3:
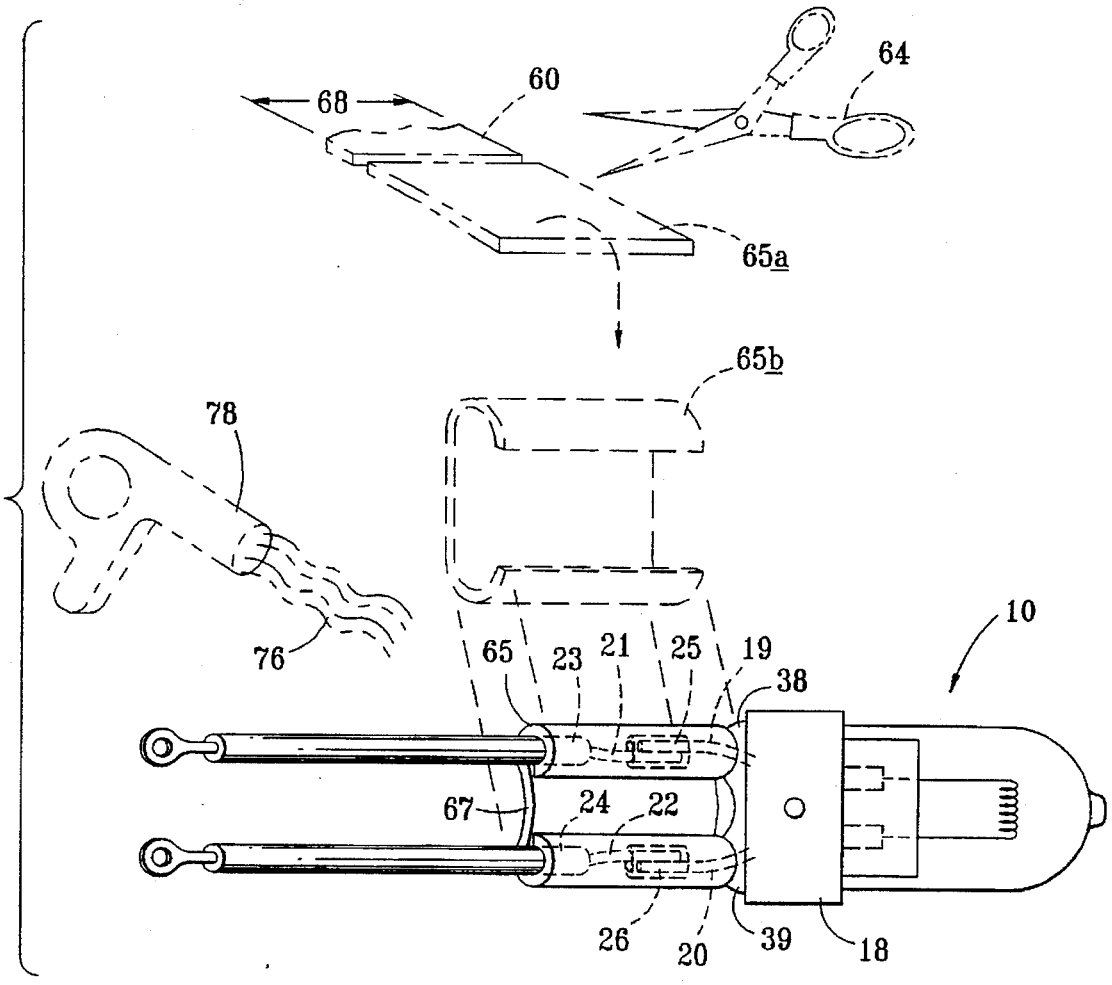
FIG. 3 is a schematic side view depicting a quartz-halogen light bulb and lead wire assembly, which is shown in the process of being constructed and/or retrofit according to another alternative embodiment of the invention, and materials and tools useful in the method of construction are schematically depicted in phantom lines for illustrative purposes.

FIG. 3 depicts a preferred alternative process by which epoxy coatings 82 and 84 (as shown in FIG. 4) are formed of an epoxy tape, which is provided or cut into at least one piece of epoxy tape 65, having a width 60 sufficient to extend from the base projections 37 and 38 to be on the attachment sites 25 and 26, and preferably to extend at least from the base projections 37 and 38 to the wire insulation 23 and 24 for each lead wire. The length of the at least one piece of tape 65 is sufficient to wrap at least one time circumferentially around terminal 19, lead wire 21 and attachment site 25, and also for extending over to and wrapping at least one time circumferentially around the other terminal 20, lead wire 22 and attachment site 26. When the at least one piece of tape 65 is thus positioned and heated with heat from a heat source, such as a heat gun 78, which is used to melt the epoxy tape 65 so that the middle portion 67 thereof begins to separate and combine with either coating 82 or coating 84. The placement of sleeves 86 and 88 over the partially melted tape 65 further separates the tape into coatings 82 and 84, which are thereby covered with sleeves 86 and 88, substantially as shown in FIG. 4, below.

FIG. 4 depicts the epoxy coatings 82 and 84, at least partially melted and securely adhered to the attachment site. Also depicted in FIG. 4 are heat-shrinkable sleeves 86 and 88, in which sleeve 86 has been moved, as, for example, from a beginning position (shown in phantom lines 86A) onto the epoxy-coated area 82, as along the path 87. In the event that distal ends 89 and 90 of wires 21 and 22, respectively, have additional connector terminals 91 and 92 fastened thereto, which are larger than the inside diameter of the sleeves 86 and 88, those additional connector terminals 91 and 92 may be removed first and then replaced or reattached after the bulb terminal pins and wire attachment sites are appropriately rigidified according to the present invention. With sleeves 86 and 88 pushed into place over the partially melted (and, therefore, partially plastic) epoxy coating 82 and 84, heat is applied to shrink the sleeves securely into position, thereby preferably squeezing a small portion 93 and 94 of epoxy coating 82 and 84 onto the base projections 37 and 38.

Figure 5:
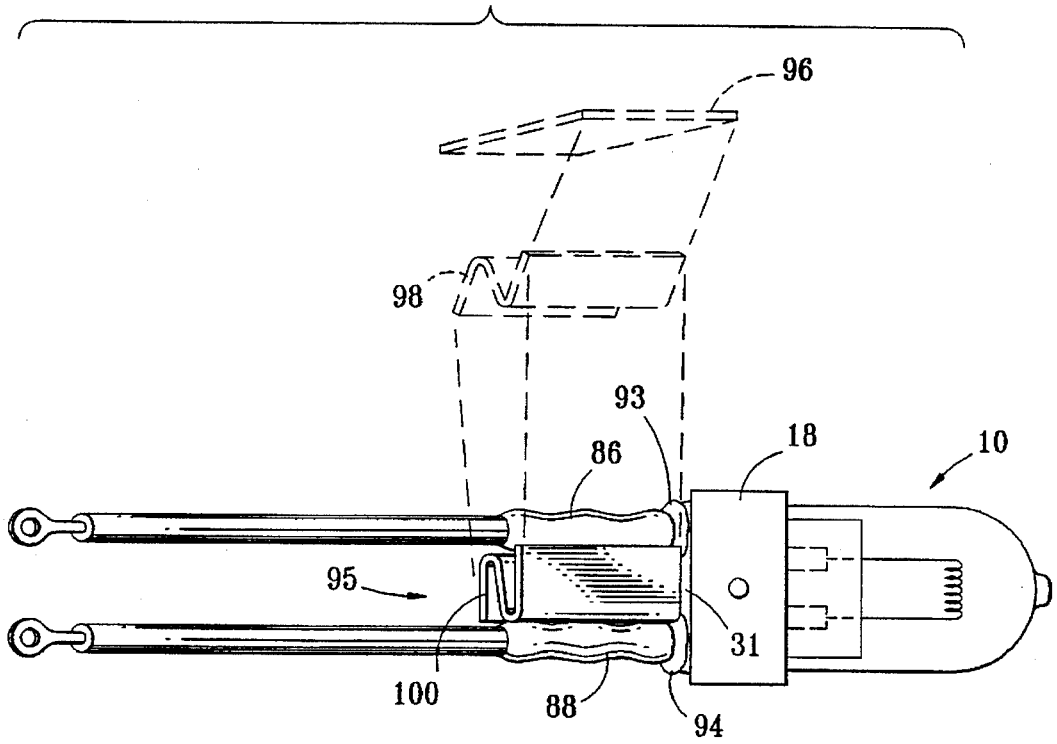
FIG. 5 is a further schematic depiction of the light bulb construction depicting additional construction continuing from the process of FIG. 4, according to the present invention.
Figure 6:
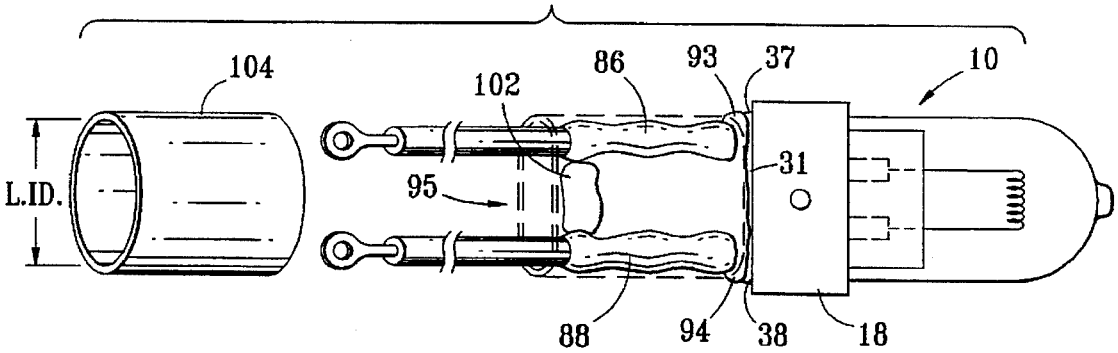
FIG. 6 is a schematic depiction of an additional construction process continuing from the process steps according to FIG. 5, according to the present invention.

Subsequently, as shown in FIGS. 5 and 6, the open space 95 (see, also, FIG. 4) between the sleeves 85 and 86 is filled with a thermal-setting epoxy material, which, in the embodiment depicted, is preferably filled with another piece 96 of thermal-setting epoxy tape 60. This epoxy tape piece 96 is cut sufficiently long for bending (as depicted at 98) and for compression (as depicted at 100) into the space 95 between the epoxy-coated and sleeved terminals and lead wire attachments extending from the base 18 of bulb 10. Again, as depicted in FIG. 5, the epoxy tape piece 96 is then partially melted through the application heat, as with a heat gun 78 (shown in FIG. 2), so that the thermal-setting epoxy adheres to the exterior of sleeves 86 and 88 and to a lower portion 31 of the base of bulb 10. The melted epoxy filler 102 preferably melts into and blends with the epoxy portions 93 and 94, all of which blended epoxy adheres to the base and to projections 37 and 38 thereof.

While the filler epoxy 102 is still partially plastisized, or partially melted, and before it is fully cured, an encompassing sleeve 104, which is a larger heat-shrinkable sleeve, is placed over all of the individual epoxy coatings 82 and 84, as well as the shrinkable sleeves 86 and 88 and the filler epoxy 102. The entire composite support structure is then subjected to heating, as with heat 76 from heat gun 78 (as depicted in FIG. 2), thereby squeezing the entire support assembly and construction into a tightly adhered composite.

Figure 7:
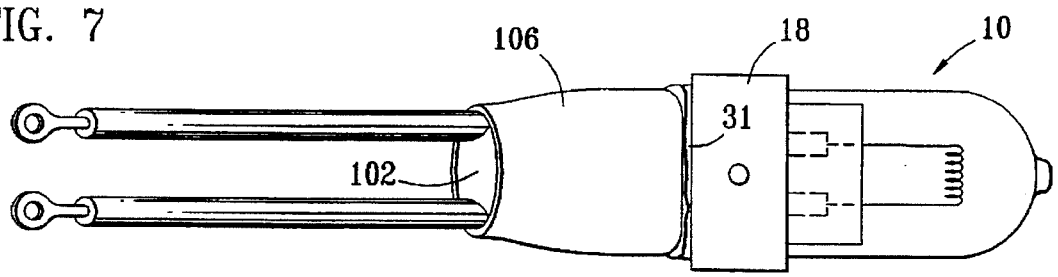
FIG. 7 is a schematic perspective view of a high temperature quart-halogen light bulb with strain- and vibration-resistant terminal and lead wire connection protection according to the present invention.

As depicted in FIG. 7, the resulting structure upon heat shrinking of encompassing sleeve 104 results in a tapered, or concave, conical shaped support structure 106. The proximal portion of melted filler material 102 blends with the proximal portions 93 and 94 of epoxy coatings 82 and 84 at the base of the light bulb. Subsequently, the entire structure is subjected to a predetermined heating temperature for a predetermined period of time to fully cure the epoxy material, which is adhered both to the various sleeve materials and also to the wires, the terminal pins and the base of the light bulb.

In the preferred embodiment, it has been found that epoxy tape 60 advantageously comprises a proprietary material, marketed by and commercially available from Raychem Corporation, of Menlo Park, California, under the name and designation "Thermofit®" adhesive S-1255-02, one-part epoxy tape. The MSDS provided for this material from Raychem lists ingredients of this material as including: "Proprietary Ingredient (CAS #Proprietary), Bisphenol A/Epichlorohydrin Epoxy Resin (CAS #25068-36-6); Cyanoguanidine (CAS #461-58-5)". This epoxy tape is post cured, as in an oven, at about 155° C.±5° C. for 90 minutes. However, for purposes of facilitating manufacturing and reducing the production time, the post cure can be advantageously accomplished at about 240° C.±5° C. for 15 minutes. The heat-shrinkable tubing for both the individual sleeves 86 and 88, and also for the encompassing sleeve 104, preferably comprises a modified fluoropolymer radiation cross-linked, flexible, abrasion-resistant, flame-retardant, heat-shrinkable tubing, marketed by and commercially available from Raychem Corporation under the name "Thermofit®" RT-555 tubing. The MSDS provided for this material from Raychem lists ingredients of this material as including: "Base polymer materials include polyethylene and olefin copolymers, fluoropolymers, chloropolymers, polyamides, polyesters, and silicones. Heat-shrinkable products may be coated with or used in conjunction with adhesives/mastics which are based on olefin copolymers or polyamides". The epoxy tape (Thermofit® S-1255-02) and the Thermofit® RT-555 tubing are highly compatible, and both have been found to withstand the high temperature and vibration environment of quartz-halogen aircraft position lights according to the present invention, while maintaining strength and electrical resistance characteristics.

The one-part epoxy tape adhesive, although reportedly tested for heat resistance by subjecting samples to heat in an oven for 336 hours at 250° C. The samples were then cooled to 23° C. and tested for adhesion tensile strength. Previous tests for this proprietary material have not been reported for the strength or durability of this material while at the elevated temperatures. Similarly, the Thermofit® RT-555 heat-shrinkable sleeve material has been tested for tensile strength after subjecting samples to 250° C. for a period of 336 hours and then cooling them to 23° C. for conducting a tensile strength test. Heat-shock testing has also been conducted in which the tubing specimens were subjected to 4 hours in a 300° C. oven, removed and cooled to 23° C. and subsequently wrapped 360 angular degrees around a mandrel to observe for evidence of drifting, flowing or cracking. While similar tests have been conducted for other materials, such as Raycom's Thermofit® adhesive S-1125 and Raychem's Viton heat-shrinkable tubing, it has been found that the Thermofit® RT-1255-02 and the Thermofit® RT-555 tubing uniquely outperforms such other materials, similarly applied, in tests by Applicant to structurally rigidify the terminal connections for quartz-halogen light bulbs in aircraft wing position light situations. Applicant has found these materials to uniquely and successfully operate in the high vibration and in the high temperature halogen light bulb application, continuously at higher temperatures greater than about 200° C. and up to about 300° C., or higher, for extended periods of time when applied according to the construction of the present invention. Therefore, Applicant has discovered a unique and unobvious process and construction for rigidifying halogen light bulb terminal connections, as described and disclosed above.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A rigidified quartz-halogen light bulb for use in aircraft light bulb mounting devices, comprising:

(a) a quartz-halogen light bulb of the type which operates at temperature of about 300° F., having a sealed glass bulb with an enclosed filament, a mounting base and at least two parallel connector terminals extending insulatedly through said mounting base and lead wires attached to said connector terminals at attachment sites;

(b) a high temperature thermal-setting epoxy coating surrounding each attachment site between said terminals and said lead wires, said thermal-setting epoxy adhered to said base at one end and extending a predetermined short distance from said base and adhered along said terminals and lead wires;

(c) individual shrink-fit sleeves securely encasing said epoxy on each of said terminals and lead wire attachment sites;

(d) interposed high temperature thermal-setting epoxy fillingly adhered between said shrink-fit sleeves and partially adhered to said base of said light bulb; and (e) an exterior shrink-fit tubing securely encasing all of said terminals, lead wires, attachment site epoxy coating, individual shrink-fit sleeves and interposed epoxy into a tightly adhered composite.

2. A rigidified quartz-halogen light bulb, as in claim 1, wherein said thermal-setting epoxy coating surrounding each attachment site comprises an adhesive, fluid-resistant, high temperature, one-part, modified epoxy resin, having characteristics substantially the same as Thermofit® adhesive S-1255-02.

3. A rigidified quartz-halogen light bulb, as in claim 1, wherein said thermal-setting epoxy coating surrounding each attachment site comprises Bisphenol A/Epichlorohydin Epoxy Resin and Cyanoguanidine.

4. A rigidified quartz-halogen light bulb, as in claim 1, wherein said individual shrink-fit sleeves comprise a modified fluoropolymer, radiation cross-linked, flexible, abrasion-resistant, flame-retarded, heat-shrinkable tubing, which has characteristics substantially the same as Thermofit® RT-555 tubing.

5. A rigidified quartz-halogen light bulb, as in claim 1, wherein said individual shrink-fit sleeves comprise polyethylene and olefin copolymers, fluoropolymers, chloropolymers, polyamides, polyesters and silicones.

6. A rigidified quartz-halogen light bulb, as in claim 1, wherein said interposed high temperature, thermal-setting epoxy comprises a fluid-resistant, high temperature, one-part epoxy adhesive, having characteristics substantially the same as Thermofit® adhesive S-1255-02.

7. A rigidified quartz-halogen light bulb, as in claim 1, wherein said interposed high temperature, thermal-setting epoxy comprises Bisphenol A/Epichlorohydin Epoxy Resin and Cyanoguanidine.

8. A rigidified quartz-halogen light bulb, as in claim 1, wherein said exterior shrink-fit tubing comprises a modified fluoropolymer, radiation cross-linked, flexible, abrasion-resistant, flame-retarded, heat-shrinkable tubing, having characteristics substantially the same as Thermofit® RT-555.

9. A rigidified quartz-halogen light bulb, as in claim 1, wherein said exterior shrink-fit tubing comprises polyethylene and olefin copolymers, fluoropolymers, chloropolymers, polyamides, polyesters and silicones.

10. A rigidified quartz-halogen light bulb, as in claim 1, wherein (a) said high temperature, thermal-setting epoxy surrounding each attachment site and said interposed high temperature, thermal-setting epoxy both comprise the same type of fluid-resistant, high temperature, one-part epoxy, which has characteristics substantially the same as Thermofit® adhesive S-1255-02; and (b) said individual shrink-fit sleeves and said exterior shrink-fit tubing are both comprised of the same type of modified fluoropolymer, radiation cross-linked, flexible, abrasion-resistant, flame-retarded, heat-shrinkable tubing, which has substantially the same characteristics as Thermofit® RT-555 tubing.

11. A rigidified quartz-halogen light bulb, as in claim 1, wherein (a) said high temperature, thermal-setting epoxy surrounding each attachment site and said interposed high temperature, thermal-setting epoxy both comprise Bisphenol A/Epichlorohydin Epoxy Resin and Cyanoguanidine; and (b) said individual shrink-fit sleeves and said exterior shrink-fit tubing are both comprised of polyethylene and olefin copolymers, fluoropolymers, chloropolymers, polyamides, polyesters and silicones.

12. A rigidified quartz-halogen light bulb, as in claim 1, wherein said lead wires are electrically insulated along a portion thereof adjacent to said attachment site and said high temperature, thermal-setting epoxy coating surrounding each attachment site and said individual shrink-fit sleeves extend from said base of said light bulb to said electrically insulated portion of said lead wires.

13. A rigidified quartz-halogen light bulb, as in claim 7, wherein said exterior shrink-fit tubing forms an inverted truncated, conical shape with said attachment sites positioned spaced apart and said lead wires are positioned closer to each other, at a distal location from said light bulb mounting base corresponding to said insulated portion of said lead wires so that upon installation said light bulb will be partially guided into position in an aircraft mounting fixture by said inverted, truncated, conical shape of said exterior shrink-fit tubing.

14. A rigidified quartz-halogen light bulb, as in claim 1, wherein said attachment sites between said terminals and said lead wires comprise smooth connector joints so that said high temperature, thermal-setting epoxy surrounding each attachment site is relatively smooth and spaced apart from each other attachment site on said light bulb.

* * * * *